United States Patent [19]

Murphy

[11] Patent Number: 4,683,983

[45] Date of Patent: Aug. 4, 1987

[54] LADDER LEVELING APPARATUS

[75] Inventor: Chester M. Murphy, Missoula, Mont.

[73] Assignee: Gerald G. Baker, Missoula, Mont. ; a part interest

[21] Appl. No.: 915,706

[22] Filed: Oct. 6, 1986

[51] Int. Cl.[4] ..... E06C 7/44

[52] U.S. Cl. ..... 182/204; 182/111

[58] Field of Search ..... 182/201-205, 182/184, 224, 108-110; 248/188.2, 188.8

[56] References Cited

U.S. PATENT DOCUMENTS

| | | | |
|---|---|---|---|
| D. 230,370 | 2/1974 | Kaye | 182/204 |
| 432,263 | 7/1890 | Dilts | 182/204 |
| 809,057 | 1/1906 | Hester | 182/204 |
| 1,013,515 | 1/1912 | Reed | 182/204 |
| 1,179,391 | 4/1916 | Bachman | 182/204 |
| 1,705,000 | 3/1929 | Brandt | 182/204 |
| 2,115,395 | 4/1938 | Marvin | 182/204 |
| 2,360,640 | 10/1944 | Bengert | 182/204 |
| 2,599,117 | 6/1952 | Maxson | 182/204 |
| 3,414,082 | 12/1968 | Gilland | 182/204 |
| 4,236,603 | 12/1980 | Talley | 182/204 |
| 4,423,797 | 1/1984 | Batten | 182/204 |
| 4,607,726 | 8/1986 | Davis | 182/204 |

*Primary Examiner*—Reinaldo P. Machado
*Attorney, Agent, or Firm*—Arthur L. Urban

[57] ABSTRACT

Ladder leveling apparatus includes a frame portion, a support portion, a slider portion, a retainer portion and a positioner portion. The frame portion includes an elongated U-shaped section, the U-shaped section including a main section having a width slightly larger than the width of a ladder leg. The main section includes at least one longitudinal channel. The support portion includes a foot member pivotally connected to the ladder leg. The foot member includes a connector section and a base section. The slider portion includes a guide member disposed within the channel, the guide member having a width slightly less than the width of the channel and a thickness slightly greater than the thickness of the main section. At least one opening extends through the guide member. The retainer portion includes a plate member disposed over the guide member, the plate member having a width significantly larger than that of the channel. An opening through the plate member is aligned with the guide opening. A bolt member extends through the plate and guide openings and extends beyond the main section a distance sufficient to pass through an opening through the thickness of the ladder leg. An adjustable fastener is disposed on the free end of the bolt member securing the ladder leg to the guide and plate members. The positioner portion includes a transverse pin member extending through aligned openings in the side sections.

14 Claims, 7 Drawing Figures

LADDER LEVELING APPARATUS

This invention relates to a novel apparatus for use with a ladder and more particularly relates to a new apparatus for leveling a ladder.

Ladders have been used throughout history. Originally, ladders were made by tying spaced cross pieces between two long poles. The spacing and parallelism of the cross pieces or rungs depended upon the eye and skill of the workman. As civilization developed, ladders were manufactured in shops and factories. Jigs and templates were employed to insure the accurate and uniform placement of the rungs. Ladders originally were constructed of wood, but more recently aluminum ladders have become popular.

Ladders today are of two general types, step ladders and extension ladders. Step ladders which ordinarily fold have an A-shaped configuration with one side having a series of steps. Extension ladders have two straight sections that are mounted in parallel adjacent planes in an overlapping relationship. The sections can be compressed for carrying and storage and extended to a desired length for use. Although the two sections usually are used together to provide a greater overall length than either section, they can be separated and used individually if desired.

While step ladders are self supporting, extension ladders have to be placed against a vertical surface such as a wall of a building. The upper end of the ladder is placed in contact with the building and the bottom end or legs of the ladder rest on the ground a distance out from the building.

Extension ladders enable a person to reach a long distance above the ground with a structure that is relatively compact, but such ladders do have certain shortcomings. They are difficult to handle and position when extended. Also, they have a very small horizontal dimension compared with their extended length. This makes them very unstable, and as a result, many injuries are incurred each year due to persons falling from extension ladders.

Some falls are the result of persons reaching two far to the side of the ladder so the center of gravity shifts away from the ladder causing it to tip over. While tipping can occur when a ladder is placed on a firm level base, the change of tipping is much greater when the ladder legs are placed on a base that slopes to the left or right. Since a ladder is very long as compared with its width, any variation in the base surface on which the ladder rests is magnified in the inclination of the ladder to the left or right of its base.

To maintain a ladder vertical under such conditions, a workman ordinarily will place an object under the bottom of the legs. Usually, a rock or wooden board is placed under the leg. While this may level the ladder at that particular position, moving the ladder to another location, e.g. along a wall, may change the inclination of the base surface requiring that a number of objects of different thicknesses be available to provide the needed leveling. This can make the leveling time-consuming and frustrating as well as of questionable safety.

In situations in which the slope is quite pronounced or involves a step, the use of thin spacers will not be sufficient. Using thicker spacers may present the additional problem of keeping the spacer in place and not shifting down the slope. Any movement of the spacer can be disastrous and result in series injury.

To overcome these problems, a number of ladder leveling devices have been proposed and patented. Examples of such include U.S. Pat. Nos. 432,263; 809,057; 1,013,515; 1,179,391; 1,705,000; 2,115,395; 2,360,640; 2,599,117; 3,414,082 and U.S. Pat. No. Des. 230,370. None of these devices have gained acceptance over the years. Some are difficult to adjust. Others are not rigid enough for safe use. Some are too expensive and still others are not adaptable to different ladders.

Although injuries have been sustained through the years and were tolerated, in recent years the very high cost of liability both in claims and insurance as well as medical expenses have created a crisis both for ladder manufacturers and also for users.

From the above discussion, it is clear that previous methods and devices for leveling ladders have not proved satisfactory for many users. Thus, there is a need for a new ladder leveling apparatus that overcomes the shortcomings of earlier designs.

The present invention provides a novel ladder leveling apparatus which not only overcomes the deficiencies of earlier devices but also has features and advantages not found in such devices. The ladder leveling apparatus of the present invention provides a high degree of safety for the user. Also, the ladder leveling apparatus can be adjusted easily and quickly to conform with different base surfaces.

The ladder leveling apparatus of the present invention is simple in design and can be produced relatively inexpensively. Commercially available materials and components can be used in the fabrication thereof. Conventional manufacturing techniques and procedures can be utilized by semi-skilled labor in the production of the apparatus.

The ladder leveling apparatus of the invention is durable in construction and has a long useful life. Little, if any, maintenance is required to keep the apparatus in good working condition.

The apparatus can be mounted on a ladder leg easily and quickly without special skills or tools. Only a minimum of instruction is required to mount and use the apparatus efficiently.

The ladder leveling apparatus can be mounted on a variety of ladders conveniently. The apparatus is adjustable to accommodate wide variations in base surfaces. The apparatus can be modified easily to meet special use conditions.

These and other benefits and advantages of the novel ladder leveling apparatus of the present invention will be apparent from the following description and the accompanying drawings in which.

Figure 1:
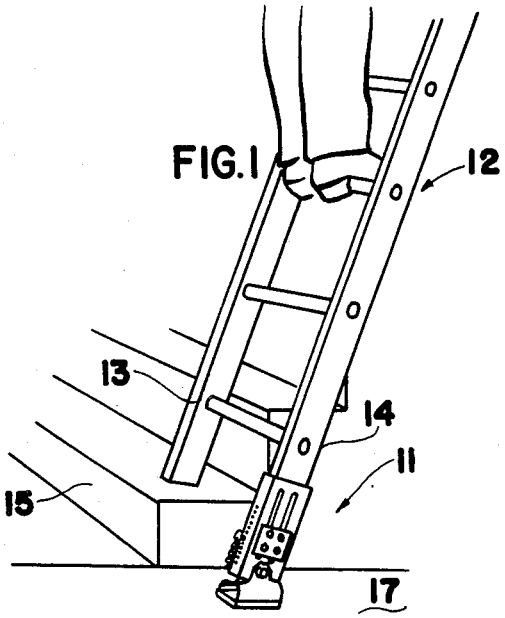
FIG. 1 is a view in perspective of one form of ladder leveling apparatus of the invention in use with a ladder.
Figure 2:
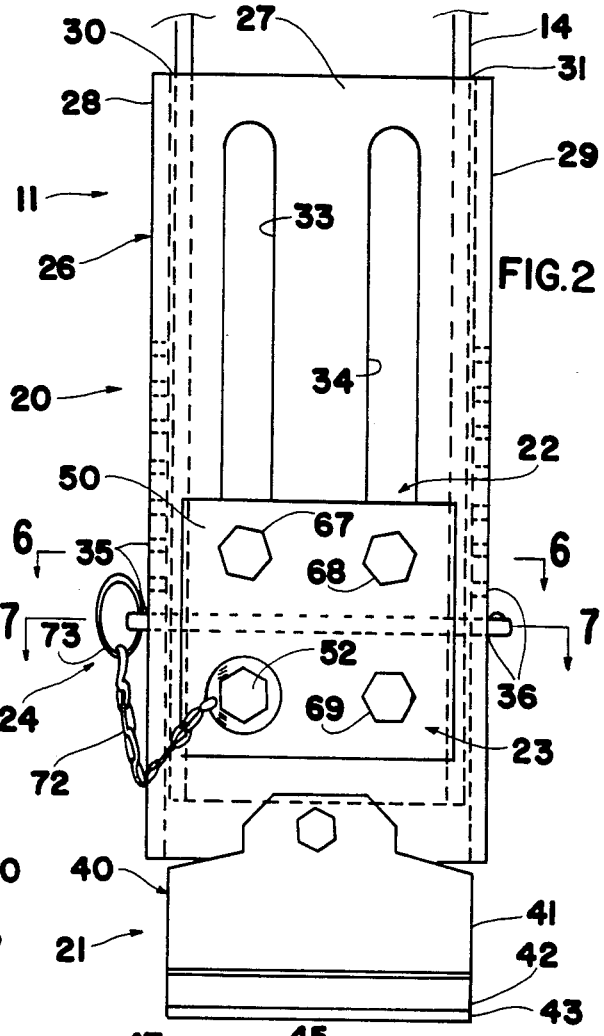
FIG. 2 is an enlarged front view of the ladder leveling apparatus shown in FIG. 1.
Figure 3:
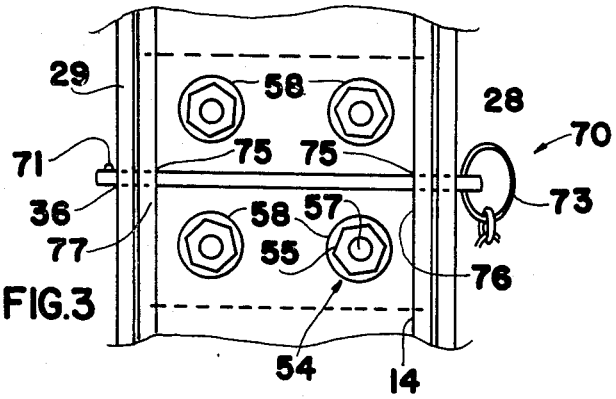
FIG. 3 is a fragmentary view of the reverse side of the ladder leveling apparatus shown in FIG. 2.
Figure 5:
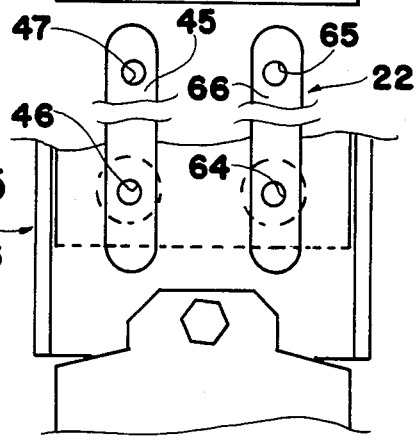
FIG. 5 is a fragmentary front view of the ladder leveling apparatus shown in FIG. 2 with the plate section removed.

As shown in the drawings, one form of the ladder leveling apparatus 11 of the present invention is mounted on a ladder 12. The ladder 12 includes legs 13 and 14. The bottom of ladder leg 13 rests on a step 15. The other ladder leg 14 which is too short to contact the ground 17 includes the ladder leveling apparatus to extend the length of the leg so the ladder 12 will be stable and can be climbed safely as shown.

The ladder leveling apparatus 11 of the invention includes a frame portion 20, a support portion 21, a slider portion 22, a retainer portion 23 and a positioner portion 24.

The frame portion 20 of the ladder leveling apparatus 11 includes an elongated U-shaped section 26. The U-shaped section 26 includes a main section 27 that has a width slightly larger than the width of ladder leg 14.

Transverse sections 28 and 29 extend from the main section adjacent side edges 30 and 31 thereof. The side sections 28 and 29 extend along substantially the entire length of the main section. The side sections have a width at least about equal to the thickness of the ladder leg.

The main section 27 and the side sections 28 and 29 advantageously are formed as a unitary structure. The frame portion 29 preferably has a length at least twice the width thereof. The transverse side sections 28 and 29 advantageously include a plurality of aligned openings 35 and 36 along the lengths thereof.

The main section 27 includes at least one longitudinal channel 33 and advantageously a plurality of channels shown in the drawings as channels 33 and 34. Preferably, the channel or channels extend along a major part of the length of the frame portion.

The support portion 21 of the ladder leveling apparatus 11 of the present invention includes a foot member 40. The foot member extends from one end (the lower end) of the frame portion 20. The foot member 40 is pivotally joined to the ladder leg 14 through a connector section 41.

The foot member 40 also includes a base section 42. The base section 42 is disposed on a free end of the connector section 41 that is remote from the ladder leg. The base section preferably includes gripping means 43.

The slider portion 22 of the ladder leveling apparatus 11 includes a guide member 45. The guide member 45 is disposed within channel 33. The guide member has a width slightly less than the width of the channel to slide freely therealong. The guide member 45 has a thickness slightly greater than the thickness of the main section 27.

The slider portion also includes at least one opening 46 through the guide member 45. Advantageously, the guide member includes more than one opening along the length thereof shown as openings 46 and 47. The guide member 45 preferably has a length more than twice the width thereof.

The retainer portion 23 of the ladder leveling apparatus 11 includes a plate member 50. The plate member is disposed over the guide member 45. The plate member 50 has a width significantly larger than the width of the channel 33. The plate member includes an opening 51 therethrough. The opening 51 is aligned with the guide member opening 46.

A bolt member 52 extends through the plate opening 51 and the guide opening 46. The bolt 52 further extends beyond the main section 27 a distance sufficient to pass through an opening 53 across the thickness of the ladder leg 14 and beyond.

Adjustable fastener means 54 shown as nut 55 is disposed on the free end 57 of bolt member 52, advantageously with a lock washer 58. Tightening the nut 55 on the bolt member secures the plate section 50, the main section 27 and the ladder leg 14 together.

The plate member 50 advantageously has a width spanning more than one channel shown as two channels 33 and 34 and has at least one and preferably two openings aligned with each channel. Thus, in addition to opening 51, the plate member includes openings 60, 61 and 62 which are aligned with openings 47, 64 and 65 respectively in first and second guide members 45 and 66 for entry of bolts 67, 68 and 69. Plate member 50 advantageously has a generally rectangular configuration although other shapes such as large washers, pairs of elongated plates and other geometric shaped plates may be employed.

The positioning portion 24 of the ladder leveling apparatus 11 of the invention includes a transverse pin member 70. The pin member 70 extends through aligned openings 35 and 36 in the side sections 28 and 29 of the frame portion 20. Advantageously, the pin member 70 includes retaining means shown as depressable ball 71 adjacent the free end of the pin member to hold the pin between the side frame sections.

The pin member 70 also includes elongated flexible means shown as chain 72. The chain 72 connects the head end 73 of the pin member with the frame portion 20 to prevent loss thereof when not disposed between the side sections.

Figure 4:
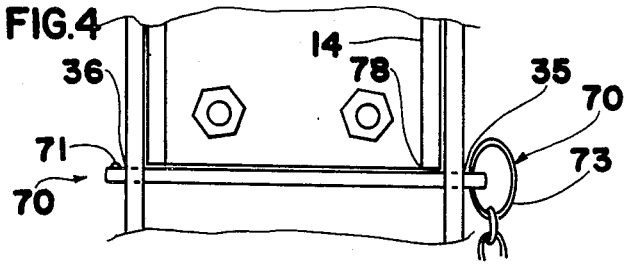
FIG. 4 is a fragmentary view of the ladder leveling apparatus shown in FIG. 3 with the positioner portion below the ladder leg.
Figure 6:
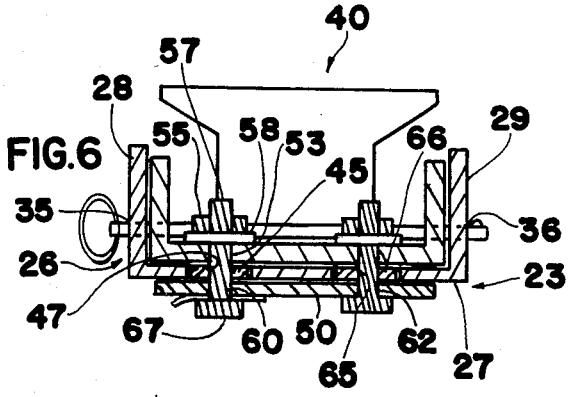
FIG. 6 is a sectional view of the ladder leveling apparatus shown in FIG. 2 taken along line 6—6 thereof.
Figure 7:
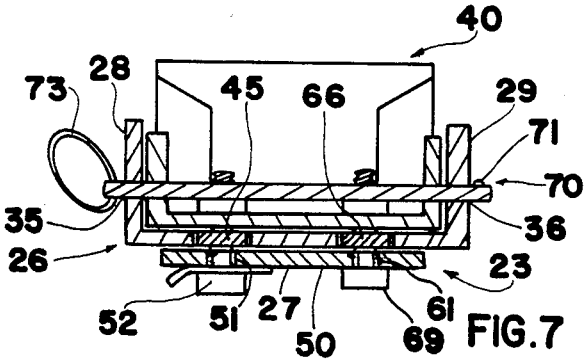
FIG. 7 is a sectional view of the ladder leveling apparatus shown in FIG. 2 taken along line 7—7 thereof.

The pin member preferably is inserted through a horizontal passage 75 that extends from one side edge 76 to the other 77 of the ladder leg 15. This arrangement further secures the ladder leg to the leveling apparatus 11. Alternatively, the pin member may be disposed below the bottom 78 of the ladder leg as shown in FIG. 4 when speed of adjustment is critical.

The ladder leveling apparatus of the invention may be fabricated from a variety of materials including metals, structural plastics, combinations thereof and the like. The materials of particular components are selected to provide high structural strength and rigidity at lowest cost.

In the use of the ladder leveling apparatus 11 of the present invention, the apparatus first is mounted on a ladder leg 14. This is accomplished by positioning the frame portion 20 over the ladder leg with the main section 27 against a major surface of the ladder leg and the side sections 28 and 29 along the side edges 76 and 77 of the ladder. Next, a number of openings 53 are drilled through the thickness of the ladder from one major face to the other. These openings 53 are aligned with the bolt members 52, 67, 68 and 69. Also, passage 75 is drilled transversely through the ladder leg.

With the nuts 55 and washers 58 removed, bolts which already extend through the plate section 50 and the guide members 45 and 66 are threaded through the openings 53 in the ladder. Nuts 55 and washers 58 are replaced on the ends 57 of the bolts and tightened. This secures the leveling apparatus 11 to the ladder leg 14 while permitting the position of the apparatus to be adjusted with repect to the ladder leg.

The frame portion 20 then is slid along the ladder leg to a position that provides the desired extension of the leg. To fix the position of the frame portion, passage 75 through the ladder leg is aligned with corresponding openings 35 and 36 in the side sections 28 and 29. Pin member 70 is inserted through the aligned openings and passage until it extends completely therethrough and ball 71 retains the pin therein. The ladder and leveling apparatus now are ready for use.

The ladder 12 is positioned against a vertical surface such as a wall of a building (not shown) with the bottom of ladder leg 13 in contact with the higher base surface shown as step 15 and the other leg 14 with the leveling apparatus in contact with the lower base surface (ground 17). If the ladder is not precisely perpendicular, the position of the apparatus 11 can be adjusted on the ladder leg by releasing downward pressure and pulling pin 70 from the apparatus. The position of the ladder is corrected and the pin replaced through another pair of openings 35 and 36 that are aligned with the ladder passage 75. This same adjustment is made when the ladder is moved to a new location.

The above description and the accompanying drawings show that the present invention provides a novel ladder leveling apparatus which not only overcomes the shortcomings of earlier methods and devices but in addition provides features and advantages not found in such devices. The ladder leveling apparatus of the invention provides a high degree of safety for the user. Also, the ladder leveling apparatus enables a user to quickly and easily adjust the ladder legs to accommodate varying base surfaces.

The ladder leveling apparatus of the invention is simple in design and can be produced relatively inexpensively from commercially available materials and components using semi-skilled labor and conventional fabricating procedures. The apparatus is durable in construction and has a long useful life with little maintenance.

The leveling apparatus can be mounted on a ladder easily and quickly without special tools or skills. The apparatus can be used efficiently after a minumum of instruction even by persons with limited mechanical aptitude or experience. The apparatus is adaptable to a wide variety of ladder designs and can be modified conveniently for special leveling situations.

It will be apparent that various modifications can be made in the particular ladder leveling apparatus described above and shown in the drawings within the scope of the present invention. The size, configuration and arrangement of components can be different to meet specific requirements. Also, additional channels, bolts and/or plates can be included if desired. These and other changes can be made in the ladder leveling apparatus provided the functioning and operation thereof are not adversely affected. Therefore, the scope of the present invention is to be limited only by the following claims.

What is claimed is:

1. Ladder leveling apparatus including a frame portion, a support portion, a slider portion, a retainer portion and a positioner portion; said frame portion including an elongated U-shaped section, said U-shaped section including a main section having a width slightly larger than the width of a ladder leg, transverse side sections extending from said main section adjacent side edges thereof along substantially the entire length of said main section, said side sections having a width at least about equal to the thickness of said ladder leg, said main section including at least one longitudinal channel; said support portion including a foot member extending from one end of said frame portion, said foot member being pivotally connected to said ladder leg, said foot member including a connector section and a base section disposed on a free end of said connector section remote from said ladder leg; said slider portion including a guide member disposed within said channel, said guide member having a width slightly less than the width of said channel and a thickness slightly greater than the thickness of said main section, at least one opening through said guide member; said retainer portion including a plate member disposed over said guide member, said plate member having a width significantly larger than that of said channel, an opening through said plate member aligned with said guide opening, a bolt member extending through said plae and guide openings and extending beyond said main section a distance sufficient to pass through an opening through the thickness of said ladder leg, adjustable fastening means disposed on the free end of said bolt member securing said ladder leg to said guide and plate members; said positioner portion including a transverse pin member extending through aligned openings in said side sections; whereby said apparatus can be connected to a ladder leg with said bolt member and said fastening mens tightened thereon, said apparatus slid along said ladder leg to a desired position, and said pin member inserted through said side sections to provide a safe extension of said ladder leg.

2. Ladder leveling apparatus according to claim 1 wherein said main section and said side sections of said frame portion are formed as a unitary structure.

3. Ladder leveling apparatus according to claim 1 wherein said frame portion has a length at least twice the width thereof.

4. Ladder leveling apparatus according to claim 1 wherein said channel extends along a major part of the length of said frame portion.

5. Ladder leveling apparatus according to claim 1 wherein said main section includes a plurality of spaced channels and said retainer portion includes a plurality of bolt members therethrough.

6. Ladders leveling apparatus according to claim 1 wherein said transverse side sections include a plurality of aligned openings along the lengths thereof.

7. Ladder leveling apparatus according to claim 1 wherein said base section of said foot member includes gripping means.

8. Ladder leveling apparatus according to claim 1 wherein said guide member has a length more than twice the width thereof.

9. Ladder leveling apparatus according to claim 8 wherein said guide member includes more than one opening along the length thereof.

10. Ladder leveling apparatus according to claim 5 wherein said plate member has a width spanning more than one channel with at least one opening aligned with each channel.

11. Ladder leveling apparatus according to claim 10 wherein said plate member has a generally quadrangular configuration with more than one opening aligned with each channel.

12. Ladder leveling apparatus according to claim 1 wherein said pin member includes retaining means holding the position thereof between said side frame sections.

13. Ladder leveling apparatus according to claim 1 wherein said ladder leg includes a horizontal passage from one side edge thereof to the other carrying said pin member between said side frame sections.

14. Ladder leveling apparatus according to claim 1 including elongated flexible means connecting a head end of said pin member with said frame portion.

* * * * *